United States Patent [19]

Hemmings et al.

[11] Patent Number: 5,071,005

[45] Date of Patent: Dec. 10, 1991

[54] MULTI-CARRIER DRILL BIT CONTAINER

[76] Inventors: David T. Hemmings, 19111 Equestrian La., Orange, Calif. 92669; Michio E. Ito, 12 Appomattox, Irvine, Calif. 92720

[21] Appl. No.: 663,577

[22] Filed: Mar. 1, 1991

[51] Int. Cl.[5] ..... B65D 85/24

[52] U.S. Cl. ..... 206/379

[58] Field of Search ..... 206/379

[56] References Cited

U.S. PATENT DOCUMENTS

| | | | |
|---|---|---|---|
| Re. 13,408 | 4/1912 | Sine | 206/379 |
| 2,437,595 | 3/1948 | Douglass | 206/379 |
| 2,513,894 | 7/1950 | Rogers | 206/379 |
| 2,962,154 | 11/1960 | Falk | 206/379 |
| 3,410,391 | 11/1968 | Kanter | 206/379 |
| 4,413,731 | 11/1983 | Weideman | 206/379 |
| 4,503,972 | 3/1985 | Nelligan et al. | 206/379 |
| 4,598,822 | 7/1986 | Hemmings | 206/379 |

FOREIGN PATENT DOCUMENTS

| | | | |
|---|---|---|---|
| 845230 | 8/1960 | United Kingdom | 206/379 |

*Primary Examiner*—William I. Price
*Attorney, Agent, or Firm*—William L. Chapin

[57] ABSTRACT

A shipping container for holding a variable number of drill bits immobile, thereby preventing potentially damaging contact of the drill bit points with interior walls of the container has a concave base section hingedly connected to a symmetrically-shaped lid section which is pivotable downwards into contact with the base to form a closed, rectangular box-like enclosure. Rows of cylindrical pins protrude upwards from the upper surface of the bottom wall of the base and are adapted to be insertably received in bores provided into the lower surface of an elongated, slab-shaped drill bit carrier, each row of pins thus holding a separate carrier in a horizontally fixed position relative to the base. A plurality of parallel vertically disposed, longitudinally spaced apart drill bit bores extending downward into each carrier from the flat upper surface of the carrier is adapted to insertably receive a plurality of drill bits, the shank of each drill bit being fitted with an annular insertion depth-limiting ring near the junction of the shank with the fluted cutting region of the drill bit. The lid is provided with a plurality of retainer plates which protrude downwards from the lower surface of the top wall of the lid. With the lid in a downward, closed position, as separte plate is positioned between adjacent pairs of drill bit bores, the lower surface of the plate being positioned just above the upper surface of insertion rings on bits positioned in the bores, thereby limiting upward movement of the rings and attached drill bits.

20 Claims, 2 Drawing Sheets

MULTI-CARRIER DRILL BIT CONTAINER

BACKGROUND OF THE INVENTION

A. Field of the Invention

This invention relates to containers used for transporting drill bits. More particularly, the invention relates to a container for holding varying numbers of drill bit carriers, each holding a quantity of drill bits, in a secure manner to protect the drill bits against damage during transportation of the drill bits.

B. Description of Background Art

Drill bits, or "drills" as they are referred to by many of their industrial users, are employed in a wide range of manufacturing industries. One particular industry which uses drills very extensively is the printed circuit board manufacturing industry. Printed circuit boards are used in a wide variety of electronic and electrical equipment in the consumer, commercial, industrial and military markets.

A typical printed circuit board has at least one layer of copper sheet and one layer of insulating board material, both of which must be penetrated by a drill during manufacture of the board. Frequently, the insulating board material is fiberglass-reinforced epoxy. Since these materials and other materials which printed circuit board drills must penetrate are typically hard and abrasive, drills used with these materials must be very hard to ensure an acceptably long life for the drills. Accordingly, most printed circuit drills are tipped with tungsten carbide, which is one of the hardest and most wear resistant materials available for industrial use.

Generally, materials which are very hard are inherently brittle. This is true of tungsten carbide, with the harder grades being more brittle than softer grades. Thus, printed circuit board (PCB) drills which are tipped with tungsten carbide, are readily susceptible to chipping and breaking of the cutting edges of the drill if not handled carefully.

Some PCB drills are fitted with an annular collar press-fitted onto the shank of the drill, a measured distance from the point. Contact of the collar with the drill machine collet, controls the depth of drill penetration. Since PCB drills are used to penetrate highly abrasive materials, the drills wear rapidly in spite of the extremely hard materials used on their cutting edges. For that reason, PCB drills are repointed three or more times before they are finally discarded. To be repointed, the drills must be removed from drill spindles, and transported to a repointing machine. Many of the repointing machines require removal of the annular shank rings before they can be repointed. This necessitates separate removal and replacement steps in conjunction with the repointing operations. When worn drills are placed helter skelter in a box for transport to a repointing machine, chipping of contacting drills often occurs.

Because of the potential for damage which can occur to PCB drills during transport, a variety of protective carrying cases intended to minimize damage to the drills have been devised.

One type of carrying case presently used has a block of resilient material such as styrofoam containing a plurality of parallel cylindrical holes. The diameter of the holes in the styrofoam are slightly smaller than the shank diameters of drills which the block is intended to accommodate. Thus, drills which are inserted shank-first into the holes are held in place by an interference fit. A disadvantage of this type of drill carrying case is that it is difficult to selectively remove a drill from the box without striking and thereby damaging an adjacent drill. Further, this type of packaging does not allow all the drill points to settle at the same height; incoming drill bit inspection is therefore difficult.

A second type drill carrying case consists of a plastic tube and end cap. With this method, drills are packaged individually.

Another type of package consists of a vacuum formed pack with cavities that approximately the shape of the drill. Each cavity accommodates 1 drill.

A third type of drill carrying case in current use has the general external shape of a thin, flat, rectangular box. The top and bottom of the box are hinged at the back, and the facing front edges of the box provided with a fastener which may be readily joined and separated. When unfastened, the top of the box is foldable backwards, placing both top and bottom of the box in a common horizontal plane. Extending perpendicularly upward from the inner surface of the back hinged surface of the box is a thin holding block spanning nearly the full width of the box. The holding block contains a plurality (twelve or so) of parallel blind holes adapted to loosely hold the shanks of drills. Foam rubber strips fastened to inner facing surfaces of the top and bottom panels of the box span the width of the box. When the top and bottom panels of the box are snapped together, compressive pressure of the resilient foam rubber strips upon the drills holds them in place. A disadvantage of this type of drill carrying case is the limited range of drill sizes which may be carried in a given case. This type case can be used for drills in the approximate size range of #97 drills (0.0059 inch diameter), to $\frac{1}{8}$" diameter drills. To accommodate drills from $\frac{1}{8}$" to $\frac{1}{4}$", excessively thick foam rubber strips would be required. If the smaller thickness strips, adequate for use with smaller diameter drills were used with the larger size range drills, the excessive percentage of foam thickness depression caused by the larger diameter drills would destroy the elastic memory of the foam strips.

In U.S. Pat. No. 4,598,822, Hemmings, July 8, 1986. Drill Bit Carry Case, the present inventor disclosed a novel protective carrying case for drill bits. That carrying case holds a removable rectangular block having parallel bores for receiving a quantity (typically 10) of drill bits. Each block has a longitudinally disposed slot which communicates with the bores. The case includes means for depressing an elastic band through the slot into contact with shanks of drills bits held within the bores, when the lid of the case is closed, thereby securing the drill bits in position with the case closed.

The present invention was conceived of to provide a protective container for drill bits which is capable of holding a plurality of carriers, each containing a quantity of drill bits.

OBJECTS OF THE INVENTION

An object of the present invention is to provide a container for drill bits which protects the cutting surfaces of the drill bits from damage.

Another object of the invention is to provide a protective container for drill bits fitted with insertion depth-limiting rings.

Another object of the invention is to provide a protective container for drill bits which is adapted to receive a plurality of drill bit carriers, each carrier holding a plurality of drill bits.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described in this specification are merely illustrative of the preferred embodiment. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved container for holding drill bits, and for protecting the drill bits during shipment or in-process movement within a manufacturing operation.

The drill bit container according to the present invention is adapted to removably receive a plurality of identical carriers, each holding several drill bits. Each carrier has the shape of an elongated, rectangularly shaped block having a plurality of bores extending perpendicularly downwards into the block from the upper face of the block. Each bore is adapted to receive a separate drill bit, downward motion into the bore being limited by contact of the shank face of the bit with a flange projecting into the lower end of the bore.

The container according to the present invention, includes a rectangular shaped box having concave, rectangular plan-view upper and lower shell sections. Rear longitudinal edge walls of the upper and lower shell section are joined together by hinges which permit the upper shell to be pivoted downwardly into contact with the lower shell section to close the container, and upwardly to open the container.

The upper surface of the bottom wall of the lower shell section has several parallel, longitudinally disposed rows of longitudinally spaced apart pins projecting perpendicularly upwards from the bottom wall. Blind bores extending perpendicularly upwards into each carrier from the bottom face of the carrier are of the proper size and location to insertably receive the upwardly projecting pins. Thus, a separate carrier may be placed downward on each longitudinally disposed row of pins, the bottom face of the carrier seating on a horizontal plane parallel to the bottom wall of the lower shell section.

The upper shell section incorporates means for preventing drill bits in a carrier from sliding out of their bores and contacting the upper shell section when the container is closed and tipped upside down. This means for limiting movement of the drill bits, thereby preventing potentially damaging contact of the drill bit points with the upper shell section, includes a plurality of parallel retainer plates which protrude perpendicularly downwards from the inner surface of the top wall of the upper shell section. Each plate has a generally rectangular shape, and spans the distance between the front and rear walls of the upper shell section.

The bottom, horizontally disposed wall surfaces of the retainer plates are of the proper spacing relative to the bottom wall of the lower shell section to contact the upper portions of annular depth insertion rings fitted onto the upper portions of drill bits, thereby retaining the drill bits in place with the upper shell closed, even if the container is tipped.

In the preferred embodiment, the transverse walls of each retainer plate taper outwards, so that the upper portion of each retainer plate is thicker than the bottom portion. The thickened upper side walls of the retainer plates are of the proper size and spacing to contact the tapered shoulders joining the shank of a drill bit to the smaller diameter, fluted cutting portion of the bit. This construction prevents the points of drill bits not fitted with rings from contacting the upper shell section.

DETAILED DESCRIPTION OF THE INVENTION

Referring now to FIGS. 1 through 5, a multi-carrier drill bit container according to the present invention is shown.

Figure 1:
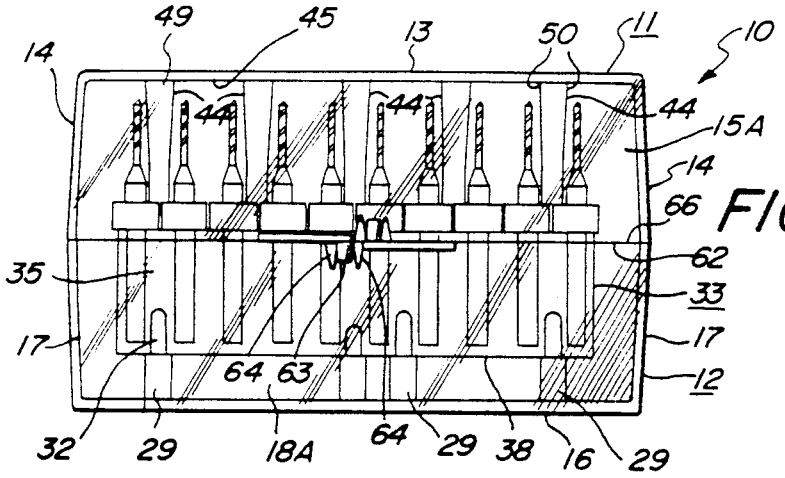
FIG. 1 is a front elevation view of a multi-carrier drill bit container according to the present invention.
Figure 2:
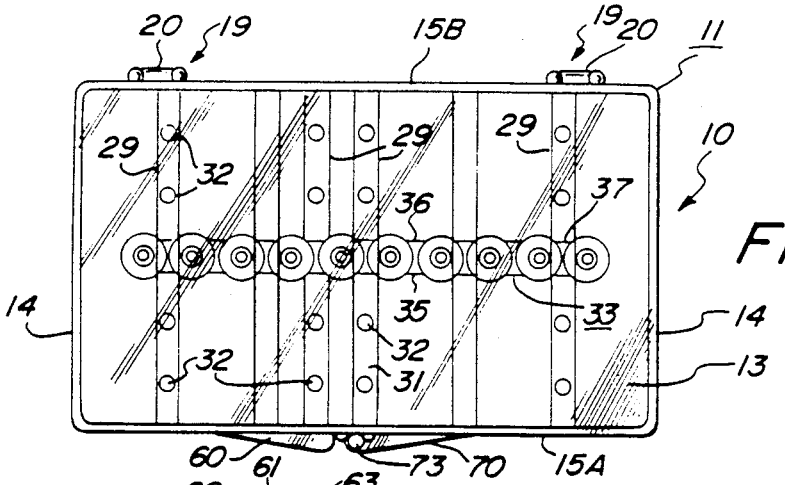
FIG. 2 is an upper plan view of the container of FIG. 1.
Figure 3:
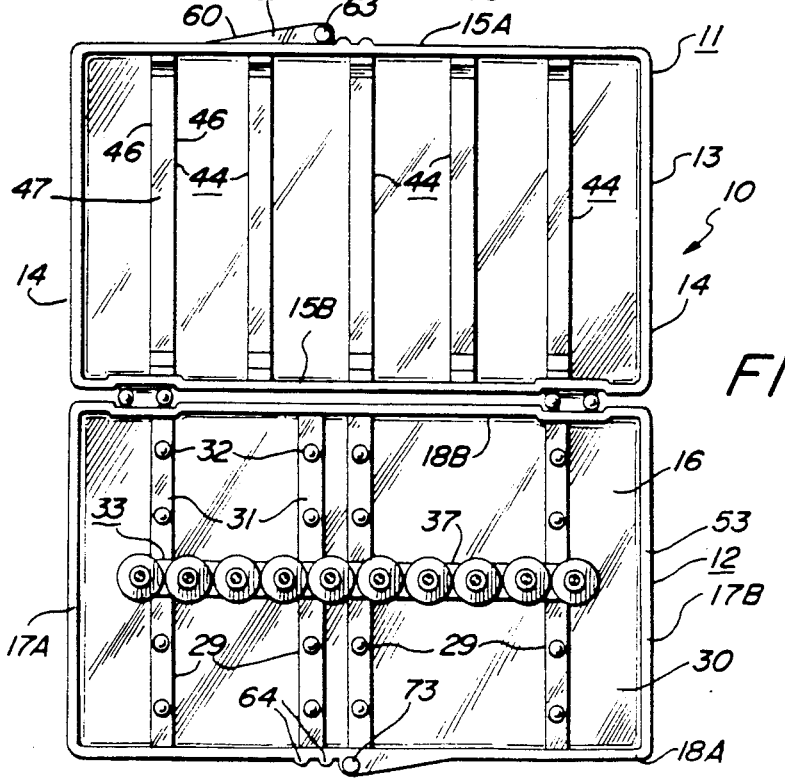
FIG. 3 is a view similar to FIG. 2, but showing the container in an open position.
Figure 4:
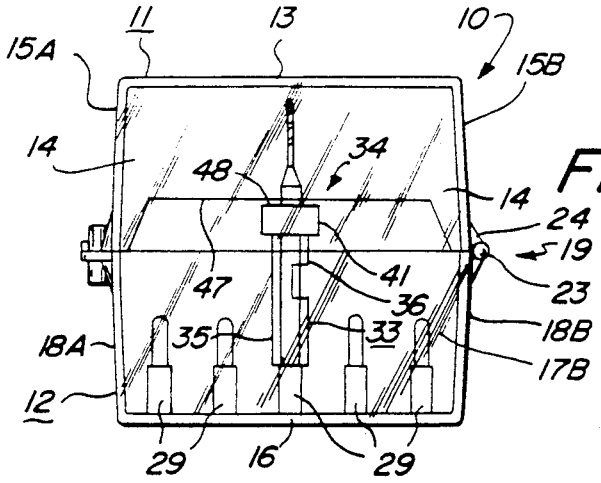
FIG. 4 is a side elevation view of the container of FIG. 1

As shown in FIGS. 1, 2 and 4, multi-carrier drill bit container 10 has the general overall exterior shape of a rectangular cross section box. As may be seen best by referring to FIGS. 3 and 4, container 10 includes an upper concave shell section, or lid 11, hingedly connected to a lower concave shell section, or base 12. Lid 11 has a laterally elongated rectangular plan-view upper wall 13. Lid 11 also has walls which depend downwards from the perimeter of upper wall 13 of lid 11. Thus, as shown in FIGS. 1 and 4, lid 11 has short left and right rectangular plan-view, flat side walls 14 which depend downwards at a slightly obtuse angle from upper wall 13 of the lid. Also, lid 11 has longer front and rear rectangular plan-view, flat side walls 15A and 15B, respectively, which depend downwards at a slightly obtuse angle from upper wall 13 of the lid. The bottom wall surfaces of left and right side walls 14, and front and rear side walls 15A and 15B of lid 11, all lie in a common plane which is parallel to upper wall 13 of the lid.

Base 12 of container 10 is constructed similarly to lid 11. Thus, as shown in FIGS. 1 and 4, base 12 has a laterally elongated, flat, rectangular plan-view lower wall 16. Lower wall section 16 has a perimeter which substantially coincides with a perpendicularly downwardly projection of the perimeter of lid 11, with container 10 in a closed position. Base 12 has short left and right, rectangular plan-view, flat side walls 17 which depend upwards at a slightly obtuse angle from lower wall 16 of the base. Base 12 also has longer front and rear rectangular plan-view flat side walls 18A and 18B, respectively, which depend upwards at a slightly obtuse angle from lower wall section 16 of the base. The upper wall surfaces of left and right side walls 17, and front and rear side walls 18 of base 12, all lie in a common plane which is parallel to lower wall 16 of the base.

Figure 5:
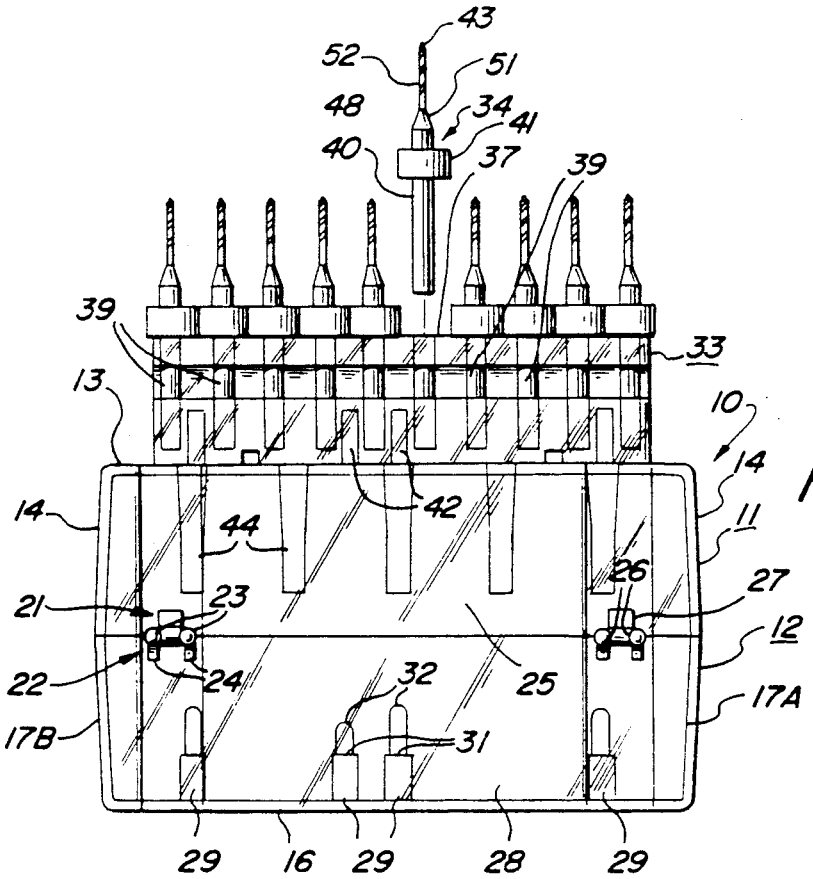
FIG. 5 is a rear elevation view of the container of FIG. 1 showing a carrier holding drill bits removed therefrom.

As may be seen best by referring to FIGS. 3, 4 and 5, rear wall 15B of lid 11 is joined by hinge means 19 to rear wall 18B of base 12. Hinge means 19 can be of any conventional type which allows pivotable movement in a vertical plane of lid 11 with respect to base 12, between a closed position as shown in FIG. 1, to an open position, as shown in FIG. 3. As shown in FIG. 5, hinge means 19 comprises two laterally spaced apart hinges 20. Each hinge 20 includes an upper portion 21 rigidly fastened to rear wall 15B of lid 11. Upper portion 21 of hinge 20 is hingedly connected to a lower portion 22 which is rigidly fastened to rear side wall 18B of base 12.

As shown in FIG. 5, upper portion 21 of hinge 20 includes a pair of laterally spaced apart balls 23 formed in the vertex of triangular-shaped ribs 24 fastened to the outer wall surface 25 of rear side wall 15B of lid 11. Balls 23 are adapted to elastically, or "snappingly" engage complementary shaped hemispherical depressions 26 in opposite lateral sides of a triangular shaped rib 27 which protrudes outwards from the outer wall surface 28 of rear side wall 18B of base 12.

Preferably lid 11 and base 12 of container 10 are fabricated by an injection molding process from a plastic such as styrene, polypropylene or acetate. Thus constructed, ball-support ribs 24 of upper portion 21 of hinge 20 may be snapped into engagement with depressions 26 in rib 27 of the lower portion 22 of hinge 20. This form of construction allows lid 11 of container 10 to be quickly fastened to base 12.

Referring now to FIG. 3, base 12 of container 10 is seen to include a plurality of parallel, laterally disposed, elongated straight ribs 29 that protrude upwards from the upper surface 30 of lower wall 16 of the base.

As shown in FIGS. 1, 3 and 4, each rib 29 has a generally square transverse cross-sectional shape, and is disposed perpendicularly between front side wall 18A and rear side wall 18B of base 12. Each rib 29 has a flat upper surface 31. A plurality of pins 32 protrudes upwards from upper surface 31 of each rib 29. Pins 32 are generally cylindrically shaped, and spaced apart from one another at equal intervals.

As may be seen best by referring to FIG. 3, each pin 32 of a rib 29 is longitudinally aligned with a pin in an adjacent rib, thus forming a plurality of parallel, longitudinally disposed rows of pins. The two laterally outermost ribs 29 are preferably spaced equal distances from the left and right side walls 17A and 17B, respectively of base 12. Preferably, base 12 includes at least one additional, intermediate rib 29 which is positioned between the two outer lateral ribs, at unequal distances therefrom. As shown in FIG. 3, base 12 may also contain a fourth intermediate rib.

The purpose of each longitudinally disposed row of pins 32 is to engage bores provided in the lower surface of a separate drill bit carrier, as will now be described.

Referring to FIGS. 1 and 3, container 10 is shown holding a carrier 33 in which are fitted a quantity of drill bits 34. Carrier 33 has the external appearance of a straight, elongated rectangular, slab-shaped body having parallel front and rear walls 35 and 36. Carrier 33 has parallel upper and lower walls 37 and 38, respectively, which are perpendicular to front and rear walls 35 and 36. A plurality of cylindrical bores 39 extends into carrier 33 from its upper wall surface 37. Bores 39 are longitudinally spaced apart at equal intervals, and are of the proper size to slidingly receive the shank 40 of a drill bit 34. For carriers 33 intended to hold drill bits 34 of the type fitted with an annular insertion depth limiting ring 41, bores 39 may extend through the entire height of the carrier, to lower wall surface 38 of the carrier.

As may be seen best by referring to FIGS. 1, 4 and 5, each carrier 33 is provided with a plurality of bores 42 extending perpendicularly upwards from lower face 37 of the carrier into the body of the carrier. Bores 42 are of the proper size and location to insertably receive pins 32 in a longitudinally disposed row. As shown in FIG. 3, a separate carrier 33 may be thus placed on separate row of pins 32. FIG. 3 shows a single carrier 33 placed in a container 10 having 5 rows of pins 32 adapted to receive 5 carriers.

Container 10 includes means for securely holding drill bits 34 against movement of a bit sufficiently to permit potentially damaging contact of the point 43 of the bit with lid 11 of the container, as will now be described.

Referring to FIGS. 1 through 4, it may be seen that lid 11 of container 10 has a plurality of parallel retainer plates 44 that protrude perpendicularly downwards from the lower surface 45 of upper wall 13 of the lid. Each retainer plate has a generally rectangular shape, substantially similar to the shape of left and right side walls 14 of the lid. Retainer plates 44 are disposed perpendicularly between front side wall 15A and rear side wall 15B of lid 11.

As may be seen best by referring to FIGS. 2 and 3, retainer plates 44 are spaced apart at regular longitudinal intervals. Moreover, the thickness of retainer plates 44, in conjunction with the spacing between adjacent retainer plates, is such as to position left and right side walls 46 of each plate equal distances away from the axes of two adjacent drill bit-holding bores 39 of a drill bit carrier 33 fitted onto a row of pins 32.

As may be seen best by referring to FIGS. 1 and 4, the spacing between the bottom wall surface 47 of each retainer plate 44 and the upper surface 37 of a carrier 33 resting on ribs 39 in base 12 of container 10 is such as to position that bottom wall surface just slightly above the upper annular surface 48 of ring 41 of a drill bit 40 fitted into bore 39 of carrier 33. Thus positioned, upward movement of ring 41, bit 40, and carrier 33 towards lid 11 is limited to a small value, even if container 10 is inverted and shaken. The clearance space between bottom wall surface 47 of retainer plates 44 and upper surface 48 of rings 41, is made sufficiently small to prevent points 43 of drill bits 34 from contacting lid 11.

As may be seen best by referring to FIG. 1, retainer plates 44 are preferably shaped so as to limit vertical movement of drill bits 34 within carrier 33, even if the bits are not fitted with insertion depth-limiting rings 41. Thus, as shown in FIG. 1, the upper portions 49 of the side walls 46 of each retainer plate 44 tapers outwards to form a thickened, wedge-shaped upper section at the junction between the plate and lower surface 45 of upper wall 13 of lid 11. The outwardly flared side walls 50 of tapered upper portion 49 of each plate 44 is of the proper size and location relative to upper surface 37 of carrier 33, with container 10 closed, for the side walls to contact the tapered annular shoulder 51 joining fluted front portion 52 of drill bit 34 to its shank 40, prior to contact of point 43 of the drill bit with lid 11, should the bit move towards the lid. Thus, constructing lid 11 with upper portions 49 of plates 44 suitably widened limits upward movement of drill bits 34 even when the bits are not fitted with rings 41, protecting the points 43 of the bits from damage. Of course, if container 10 is intended to hold only drill bits fitted with annular rings, the upper ends of plates 44 need not be widened.

Figure 6:
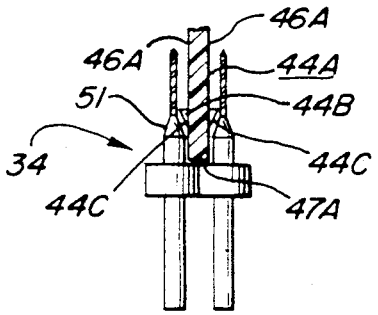
FIG. 6 is a fragmentary front elevation view of a modified version of the lid of the container of FIG. 1.

FIG. 6 illustrates a modification to lid 11 of container 10. In the modification shown in FIG. 6, retainer plates 44A have, a uniform cross-section. A pair of parallel ribs 44B, each having a triangular transverse cross-section protrudes outwards from opposite side walls 46A of each retainer plate 44A. Ribs 44B are disposed perpendicularly between front side wall 15 and rear side wall 15B of lid 11. Each rib 44B has a sloping lower surface 44C which is adapted to contact the tapered annular shoulder 51 of a drill bit 34, thus limiting upward movement of the drill bits.

As was stated above, in the preferred embodiment of container 10, upper surfaces 31 of ribs 29 which support drill bit carriers 33 are elevated above the upper surface 30 of lower wall 16 of base 12. The purpose of this height difference is to raise the upper surface 37 of carriers 33 above top edge wall 53 of base 12 sufficiently to facilitate grasping a carrier while inserting or removing the carrier from container 10. With the upper surfaces 37 of carriers 33 thus elevated above top edge wall 53 of base 12, the bottom wall surfaces 47 of plates 44 are notched upwardly so that those surfaces are properly positioned above rings 41 when lid 11 is closed on base 12, as shown in FIG. 4.

Container 10, as described above, is adapted to hold a single drill bit carrier 33, as shown in FIGS. 1–4, or a plurality of carriers, one each fitted onto a separate longitudinally disposed row of pins 32. In the embodiment shown in FIGS. 1–4, container 10 has five rows of pins 32. Thus, that embodiment of container 10 may contain from one to five drill bit carriers 33, each carrier holding up to ten drill bits. Thus, container 10 provides safe storage and transportation means for any number of drill bits, in the range of one to fifty drill bits.

Container 10 preferably includes integral means for releasably fastening lid 11 to base 12 with the container in a closed configuration. As may be seen best by referring to FIGS. 1 and 4, the means for fastening lid 11 to base 12 consists of resiliently or "snappingly" engageable members formed in front side wall 15A of lid 11 and front side wall 18A of base 12. Thus, as shown in FIG. 1, a thin triangular web 60 protrudes perpendicularly outwards from front side wall 15A of lid 11, the lower surface 61 of the web being coextensive with the lower edge wall 62 of the front side wall. A cylindrical pin 63 protrudes perpendicularly downwards from lower edge wall 61 of web 60, just leftwards from the transverse center plane of lid 11.

Front side wall 18A of base 12 includes means for resiliently engaging pin 63. This means comprises a pair of inverted adjacent semi-conical members 64 protruding forward from the front side wall 18A of base 12. The axes of semiconical members 64 are vertical and parallel to one another. The semi-circular bases 65 of semi-conical members 64 are coextensive with the upper edge wall 66 of front side wall 18A of base 12. The lateral spacing of semi-conical members 64 is of the proper value to resiliently, or "snappingly" engage cylindrical pin 63 when lid 11 is pivoted downwards to cause lower edge wall 62 of the lid to contact upper edge wall 66 of base 12.

Preferably container 10 includes a second fastener complementary to the fastener described above. Thus, as shown in FIG. 1, a second triangular web 70 having an upwardly protruding cylindrical pin 73 is formed in front side wall 18A of base 12. Also, semi-conical members 74 are formed in front side wall 15A of lid 11, and are adapted to snappingly engage pin 73.

What is claimed is:

1. A container for storing and transporting drill bits;

a. an upwardly concave base section having a bottom wall and side walls which depend upwardly from the perimeter of said bottom wall, said base section having means for holding a plurality of drill bits oriented perpendicularly to said bottom wall, and b. a downwardly concave lid section having a top wall with a plan-view shape and size similar to said bottom wall of said base section, said lid section having side walls which depend downwardly from the perimeter of said top wall, said lid section being conformable over said base section with the lower surfaces of said side walls of said lid section in contact with corresponding upper surfaces of said base section side walls, thereby forming a closed space between said lid section and said base section, said lid section having means for limiting upward motion of said drill bits so as to prevent the points of said drill bits from contacting any portion of said container.

2. The container of claim 1 wherein said means for holding a plurality of drill bits oriented perpendicularly to said bottom wall comprises in combination;

a. an elongated, block-shaped carrier having a plurality of parallel bores extending downwards into said block from its upper surface, each bore being adapted to slidably receive a separate drill bit, and b. means incorporated into said base section for removably receiving in a spaced apart relationship a plurality of said carriers.

3. The container of claim 2 wherein said means for removably receiving said carriers comprises in combination;

a. a plurality of rows of spaced apart pins protruding upwards from said bottom wall of said base section, and b. a plurality of bores extending upwards into said carrier from the lower face thereof, said pin bores being of the proper size and spacing relationship to insertably receive pins in a given row of pins.

4. The container of claim 3 wherein said means for limiting upward motion of said drill bit comprises in combination;

a. an annular ring fitted onto the shank of each of said drill bits, rearward of the fluted cutting portion of said drill bit, and b. at least one retainer plate member protruding downwards from the lower, inner surface of said top wall of said lid section, said plate member being of the proper size and location for the lower surface of said retainer plate member to be positioned above said annular ring with said lid section closed on said base section, thereby limiting upward movement of said annular ring and said drill bit attached thereto.

5. The container of claim 4 wherein said retainer plate member is further defined as being a thin plate, said plate depending perpendicularly downwards from said top wall of said lid section.

6. The container of claim 5 wherein said lid section of said container is hingedly attached to said base section.

7. The container of claim 6 further including means for releasably fastening said lid section of said container to said base section in a closed, contacting relationship therewith.

8. The container of claim 5 wherein said retainer plate is further defined as having an upper section adjacent said top wall of said lid section, said upper section having side walls which taper outwards to form a thickened root, said tapered side walls being adapted to contact a shoulder joining a reduced diameter fluted section of a drill bit to the shank section of the drill bit, thereby limiting upward movement of said drill bit towards said top wall.

9. The container of claim 8 wherein said lid section of said container is hingedly attached to said base section.

10. The container of claim 9 further including means for releasably fastening said lid section of said container to said base section in a closed, contacting relationship therewith.

11. A container for storing and transporting drill bits comprising;

a an upwardly concave base section having a generally flat, polygonal bottom wall and side walls which depend upwardly from the perimeter of said bottom wall, said bottom wall having a plurality of longitudinally disposed, parallel, laterally spaced apart rows of longitudinally spaced apart pins which protrude upwards from the upper surface of said bottom wall, each row of said pins being adapted to receive a longitudinally elongated, block-shaped drill bit carrier having bores extending downwards into said block from the upper face of the carrier for receiving a row of drill bits, each fitted with an annular ring on the upper part of its shank and pin-receiving bores extending upward into said block for insertably receiving each of the pins in a row of said pins, b. a downwardly concave lid section having a generally flat, polygonal top wall similar in size and shape to said bottom wall of said base section, said lid section having side walls which depend downwardly from the perimeter of said top wall, said top wall having a plurality of laterally disposed retainer plates which protrude downwards from the lower surface of said top wall, each of said plates having a lower portion which lies between adjacent drill bit bores and above the upper surface of said drill bit carrier, with said lid section in a closed, contacting relationship with said base section, said lower portion of said retainer plate being of the proper size and shape to abut the upper surface of said annular ring and thereby limit upward movement of said annular ring and said drill bit towards said lid section.

12. The container of claim 11 further including standoff members located between said pins and said upper surface of said bottom wall of said base section of said container, said standoff members holding said bottom surfaces of said carriers upwardly spaced apart from said upper surface of said bottom wall, thereby facilitating insertion and removal of said carriers.

13. The container of claim 12 wherein said standoff members are further defined as being a plurality of straight ribs protruding upwards from said upper surface of said bottom wall of said base section.

14. The container of claim 13 wherein said lid section is hingedly connected to said base section.

15. The container of claim 14 wherein the upper surfaces of said side walls of said base section lie in common plane parallel to said bottom wall of said base section, and said lower surfaces of said side walls of said lid section lie in a common plane parallel to said top wall of said lid section, said upper and lower side wall surfaces being adapted to contact one another with said lid section in a closed position relative to said base section.

16. The container of claim 15 further including means for releasably fastening said lid section in a closed position relative to said base section.

17. The container of claim 16 wherein said polygonal shape of said bottom wall of said base section and said top wall of said lid section is further defined as being a rectangle.

18. The container of claim 17 wherein said retainer plates are further defined as having a generally rectangular plan-view shape, the lower edge wall of which is recessed upwards over nearly its whole length.

19. The container of claim 17 wherein each of said retainer plates is further defined as having an upper section adjacent said top wall of said lid section, said upper section having side walls which taper outwards to form a thickened root, said tapered side walls being adapted to contact a shoulder joining a reduced diameter fluted section of a drill bit to the shank section of the drill bit, thereby limiting upward movement of said drill bit towards said top wall.

20. The container of claim 17 wherein each of said retainer plates is further defined as including at least one elongated rib protruding outwards from a side wall of said plate, above the bottom wall of said plate, said rib being disposed parallel to said bottom wall and being adapted to abut the tapered annular shoulder of a drill bit.

* * * * *

UNITED STATES PATENT AND TRADEMARK OFFICE

CERTIFICATE OF CORRECTION

PATENT NO. : 5,071,005

DATED : December 10, 1991

INVENTOR(S) : Hemmings, David T. and Ito, Michio E.

It is certified that error appears in the above-identified patent and that said Letters Patent is hereby corrected as shown below:

On the Title page

In the Abstract: In the 6th line from the end of the abstract, delete "as separte" and insert "a separate"

Column 3, line 10: Delete "I" and insert"We"
Column 3, line 12: Delete "I" and insert "We"
Column 8, line 7( line 1 of claim 1 ): Insert "comprising" between "bits" and the semicolon.

Signed and Sealed this

Twenty-sixth Day of January, 1993

*Attest:*

DOUGLAS B. COMER

*Attesting Officer*

*Acting Commissioner of Patents and Trademarks*

US005071005A

REEXAMINATION CERTIFICATE (2677th)

United States Patent [19]

[11] B1 5,071,005

Hemmings et al.

[45] Certificate Issued Sep. 19, 1995

[54] MULTI-CARRIER DRILL BIT CONTAINER

[76] Inventors: David T. Hemmings, 19111 Equestrian La., Orange, Calif. 92669; Michio E. Ito, 12 Appomattox, Irvine, Calif. 92720

Reexamination Request:
No. 90/003,548, Sep. 1, 1994

Reexamination Certificate for:

| | |
|---|---|
| Patent No.: | **5,071,005** |
| Issued: | **Dec. 10, 1991** |
| Appl. No.: | **663,577** |
| Filed: | **Mar. 1, 1991** |

Certificate of Correction issued Jan. 26, 1993.

[51] Int. Cl.[6] ..... B65D 85/24
[52] U.S. Cl. ..... 206/379; 206/443
[58] Field of Search ..... 206/379, 369, 378, 372, 206/443; 211/69

[56] References Cited

U.S. PATENT DOCUMENTS

| | | | |
|---|---|---|---|
| Re. 13,408 | 4/1912 | Sine | 206/379 X |
| 2,437,595 | 3/1948 | Douglass | 206/379 |
| 2,513,894 | 7/1950 | Rogers | 206/379 |
| 2,962,154 | 11/1960 | Falk | 206/379 |
| 2,971,637 | 2/1961 | Simons | 206/369 |
| 3,410,391 | 11/1968 | Kanter | 206/379 X |
| 4,244,469 | 1/1981 | Miner . | |
| 4,324,331 | 4/1982 | Ignasiak . | |
| 4,413,731 | 11/1983 | Weideman | 206/379 |
| 4,503,972 | 3/1985 | Nelligan et al. | 206/379 |
| 4,598,822 | 7/1986 | Hemmings | 206/379 |
| 4,619,364 | 10/1986 | Czopor, Jr. . | |
| 4,770,297 | 9/1988 | Chang . | |
| 4,909,386 | 3/1990 | Jeffers . | |
| 4,934,530 | 6/1990 | Riess . | |
| 4,942,966 | 7/1990 | Kemp . | |
| 4,958,732 | 9/1990 | Rau et al. . | |

FOREIGN PATENT DOCUMENTS

| | | | |
|---|---|---|---|
| 6705407 | 1/1968 | Netherlands | 206/443 |
| 845230 | 8/1960 | United Kingdom | 206/379 |

OTHER PUBLICATIONS

Tulon Carbide Bur Price List 1979.
Photograph of Metal Removal Drill Bit Container Sealed with Inopcher Seal, Nov. 1989.

*Primary Examiner*—Bryon P. Gehman

[57] ABSTRACT

A shipping container for holding a variable number of drill bits immobile, thereby preventing potentially damaging contact of the drill bit points with interior walls of the container has a concave base section hingedly connected to a symmetrically-shaped lid section which is pivotable downwards into contact with the base to form a closed, rectangular box-like enclosure. Rows of cylindrical pins protrude upwards from the upper surface of the bottom wall of the base and are adapted to be insertably received in bores provided into the lower surface of an elongated, slab-shaped drill bit carrier, each row of pins thus holding a separate carrier in a horizontally fixed position relative to the base. A plurality of parallel vertically disposed, longitudinally spaced apart drill bit bores extending downward into each carrier from the flat upper surface of the carrier is adapted to insertably receive a plurality of drill bits, the shank of each drill bit being fitted with an annular insertion depth-limiting ring near the junction of the shank with the fluted cutting region of the drill bit. The lid is provided with a plurality of retainer plates which protrude downwards from the lower surface of the top wall of the lid. With the lid in a downward, closed position, a separate plate is positioned between adjacent pairs of drill bit bores, the lower surface of the plate being positioned just above the upper surface of insertion rings on bits positioned in the bores, thereby limiting upward movement of the rings and attached drill bits.

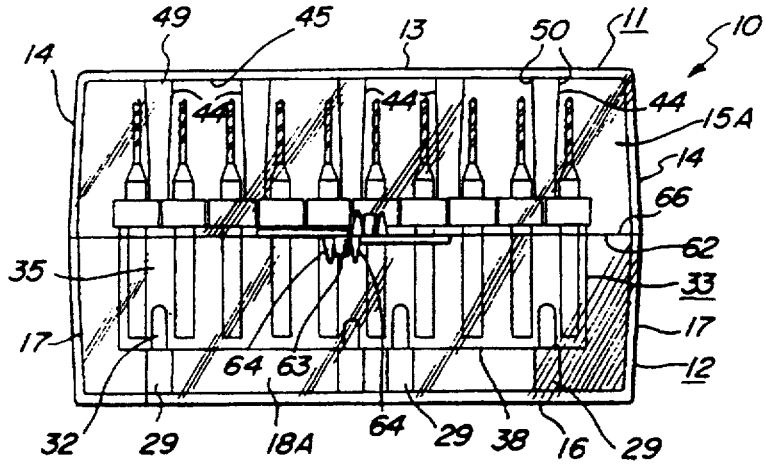

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 11–20 is confirmed.

Claims 1, 2 and 4 are determined to be patentable as amended.

Claims 3, 5–10, dependent on an amended claim, are determined to be patentable.

1. A container for storing and transporting drill bits *of the type having an elongated cylindrical shank, said container comprising:* a. an upwardly concave base section having a bottom wall and side walls which depend upwardly from the perimeter of said bottom wall, said base section having means for holding a plurality of drill bits oriented perpendicularly to said bottom wall, and b. a downwardly concave lid section having a top wall with a plan-view shape and size similar to said bottom wall of said base section, said lid section having side walls which depend downwardly from the perimeter of said top wall, said lid section being conformable over said base section with the lower surfaces of said side walls of said lid section in contact with corresponding upper surfaces of said base section side walls, thereby forming a closed space between said lid section and said base section, said lid section having means *radially displaced from the shanks of said drill bits* for limiting upward motion of said drill bits so as to prevent the points of said drill bits from contacting any portion of said container.

2. The container of claim 1 wherein said means for holding a plurality of drill bits oriented perpendicularly to said bottom wall comprises in combination:

a. [an] *at least one* elongated, block-shaped carrier having a plurality of parallel bores extending downwards into said [block] *carrier* from [its] *the* upper surface *thereof*, each bore being adapted to slidably receive a separate drill bit, and b. means incorporated into said base section for removably [receiving] *receiving, and for simultaneously holding,* in a *laterally* spaced apart *fixed* relationship [a plurality] *with respect to said side walls of said base section one or more* of said carriers.

4. The container of claim [3] *1* wherein said means for limiting upward motion of said drill bit comprises in combination:

a. an annular ring fitted onto the shank of each of said drill bits, rearward of the fluted cutting portion of said drill bit, and b. at least one retainer plate member protruding downwards from the lower, inner surface of said top wall of said lid section, said plate member being of the proper size and location for the lower surface of said retainer plate member to be positioned above said annular ring with said lid section closed on said base section, thereby limiting upward movement of said annular ring and said drill bit attached thereto.

* * * * *